US007828288B2

(12) United States Patent
Kim et al.

(10) Patent No.: US 7,828,288 B2
(45) Date of Patent: Nov. 9, 2010

(54) MULTI-FUNCTIONAL PERIPHERAL DEVICE AND ADJUSTABLE PAPER OUTPUT HOLDER

(75) Inventors: Young-min Kim, Suwon-si (KR); Sang-cheol Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 595 days.

(21) Appl. No.: 11/124,122

(22) Filed: May 9, 2005

(65) Prior Publication Data

US 2005/0275149 A1 Dec. 15, 2005

(30) Foreign Application Priority Data

Jun. 10, 2004 (KR) ..... 2004-42505

(51) Int. Cl.
*B65H 29/50* (2006.01)

(52) U.S. Cl. ..... 271/200; 271/207; 399/405

(58) Field of Classification Search ..... 271/200, 271/207, 314; 399/405, 110, 126, 391, 393; 347/104

See application file for complete search history.

(56) References Cited

U.S. PATENT DOCUMENTS

| | | | | |
|---|---|---|---|---|
| 1,141,277 | A * | 6/1915 | Smith | 271/199 |
| 2,606,669 | A * | 8/1952 | Morrison | 414/790.7 |
| 2,660,432 | A * | 11/1953 | Wilske et. al. | 271/201 |
| 4,232,987 | A * | 11/1980 | Giordano | 414/331.09 |
| 4,279,555 | A * | 7/1981 | Rydell | 414/793.8 |
| 4,322,069 | A * | 3/1982 | Mitchell | 271/296 |
| 4,589,758 | A * | 5/1986 | Kasama et al. | 399/122 |
| 4,671,644 | A * | 6/1987 | Sumida et al. | 399/124 |
| 4,822,025 | A | 4/1989 | Chung | |
| 5,439,209 | A * | 8/1995 | Runzi | 271/251 |
| 5,870,647 | A * | 2/1999 | Nada et al. | 399/18 |
| 7,107,004 | B2 * | 9/2006 | Saito | 399/405 |

FOREIGN PATENT DOCUMENTS

| | | | |
|---|---|---|---|
| JP | 63-66065 | | 3/1988 |
| JP | 2-70663 | | 3/1990 |
| JP | 10-109814 | | 4/1998 |
| JP | 11-122406 | * | 4/1999 |
| JP | 2001-326770 | * | 11/2001 |
| JP | 2002-23437 | * | 1/2002 |
| JP | 2002-128374 | | 5/2002 |
| JP | 2002-179323 | | 6/2002 |
| JP | 1-176775 | | 7/2005 |
| KR | 2002-0080271 | | 10/2002 |

* cited by examiner

*Primary Examiner*—Saúl J Rodriguez
*Assistant Examiner*—Thomas A Morrison
(74) *Attorney, Agent, or Firm*—Staas & Halsey LLP

(57) ABSTRACT

A multi-functional peripheral device is provided. The multi-functional peripheral device includes a bottom frame and a top frame that is installed so as to be movable with respect to the bottom frame. The height of a paper stacker, to which paper is delivered and stacked, is controllable, since the top frame is movable with respect to the bottom frame.

7 Claims, 9 Drawing Sheets

MULTI-FUNCTIONAL PERIPHERAL DEVICE AND ADJUSTABLE PAPER OUTPUT HOLDER

CROSS-REFERENCE TO RELATED APPLICATIONS

This application claims the benefit from Korean Patent Application No. 10-2004-0042505, filed on Jun. 10, 2004, in the Korean Intellectual Property Office, the disclosure of which is incorporated hereby incorporated by reference.

BACKGROUND OF THE INVENTION

1. Field of the Invention

The present invention relates to a multi-functional peripheral device, and more particularly, to a multi-functional peripheral device including a paper output holder having a height that is adjustable by moving an upper frame with respect to a lower frame.

2. Description of the Related Art

Generally, a multi-functional peripheral device combines a scanning function that reads a document and inputs an image, a printing function that prints the image, and other functions into one device.

FIG. 1 is a cross-sectional view of a conventional multi-functional peripheral device. Referring to FIG. 1, the multi-functional peripheral device includes an image forming unit 10. An image inputting unit 80, and a paper output holder 70 are interposed between the image forming unit 10 and the image inputting unit 80, to which print paper S with a toner image formed thereon are delivered and then stacked.

The image forming unit 10 prints a desired image, and is on a lower portion of a main body 1. The image forming unit 10 includes a paper cassette 20, a developing device 30, a transfer roller 32, a fixing device 50, and a paper output device 60.

The paper cassette 20 stacks the print paper S, and is detachably installed in the main body 1. A pickup roller 21 is installed on the upper portion of the paper cassette 20 to pick up an single sheet of the print paper S.

The developing device 30 has a photosensitive drum 31 that is partially exposed and installed so as to be directly above the transfer roller 32 with the print paper S between the photosensitive drum 31 and the transfer roller 32. An electrostatic latent image is formed on a surface of the photosensitive drum 31 that is charged with a predetermined electrostatic potential by an exposing unit 40 such as a laser scanning unit (LSU).

The transfer roller 32 is installed so as to be directly below, and in contact with, the photosensitive drum 31. The transfer roller 32 transfers the toner image formed on the surface of the photosensitive drum 31 onto the print paper S.

The fixing device 50 is installed in a traveling path of the print paper S. The fixing device 50 applies heat and pressure to the toner image transferred onto the print paper S by the transfer roller 32 so as to fuse and fix the toner image onto the print paper S.

The paper output device 60 outputs the print paper S, on which the toner image is fused and fixed by the fixing device 50, to the paper output holder 70. An out-bin full sensor 61 senses the print paper S stacked on the paper output holder 70.

The image inputting unit 80 mounted on the upper portion of the main body 1 emits light onto a document (not shown) and scans an image. The image inputting unit 80 is composed of a glass plate 82 that is installed on the top portion of the main body, a cover 81 that is installed so as to be folded towards the main body 1 or extended outward to expose the glass plate 82 to the outside. The image inputting unit 80 also includes an image sensor 83 installed below the glass plate 82 to emit light onto the document placed on the top surface of the glass plate 82 and input the image.

The print paper S, picked up in the paper cassette 20, moves along the paper traveling path and forms an image thereon, and is output to the paper output holder 70 via the paper output device 60 and stacked therein. If the paper output holder 70 is overloaded with print paper S, the sensor 61 detects the overload and indicates the occurrence of the overload at the paper output holder 70 to a user. Thus, the user is able to take appropriate measures to correct the overload.

The multi-functional peripheral device configured, in the above-mentioned way, has the image forming unit 10 on the lower portion of the main body and the image inputting unit 80 on the upper portion of the main body 1, and the paper output holder 70 therebetween. Therefore, the conventional multi-functional peripheral device has a structure that does not provide a strong support for the image inputting unit 10.

In addition, only a limited amount of -paper S can be stacked on the paper output holder 70 because the height of the paper output holder 70 is restricted. Furthermore, the heat accumulated on the print paper S when printing increases the temperature of the paper output holder 70. The heat accumulated on the paper output holder 70 in such a way is transmitted to the image inputting unit 80 and reduces the functions of the image inputting unit 80 and deteriorates a frame (not shown).

SUMMARY OF THE INVENTION

The present invention provides an image forming apparatus that improves cooling by blocking the heat that is generated from an image forming unit from being transmitted to an image inputting unit. In addition, the present invention controls an amount of paper stacked on a delivery unit by controlling the height of the paper stack.

According to an aspect of the present invention, a multi-functional peripheral device including a lower frame and an upper frame, which is installed so as to be able to move with respect to the lower frame to control the height of a paper stack by adjusting the upper frame with respect to the lower frame, is provided.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
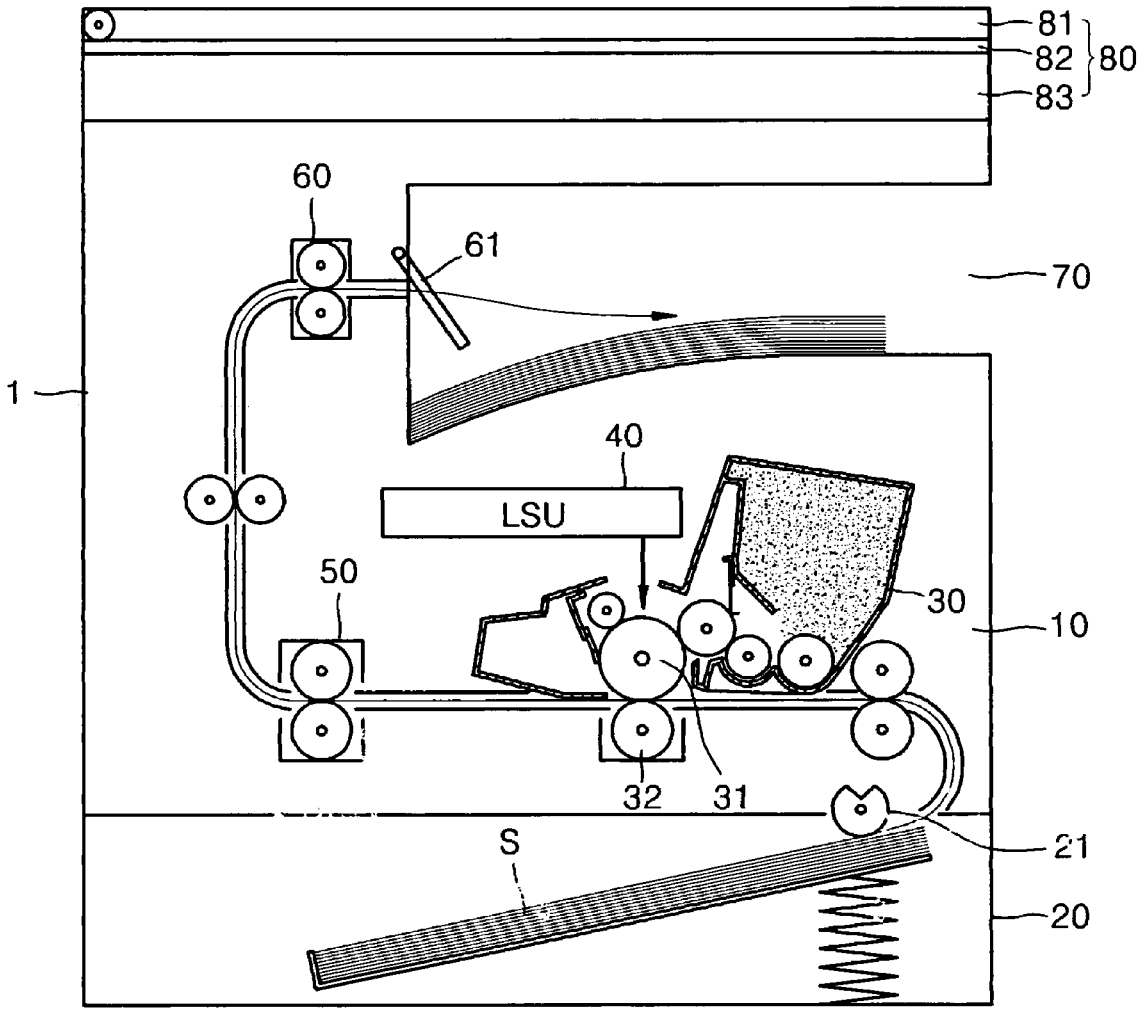
FIG. 1 (PRIOR ART)
FIG. 1 is a cross-sectional view of a conventional multi-functional peripheral device.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
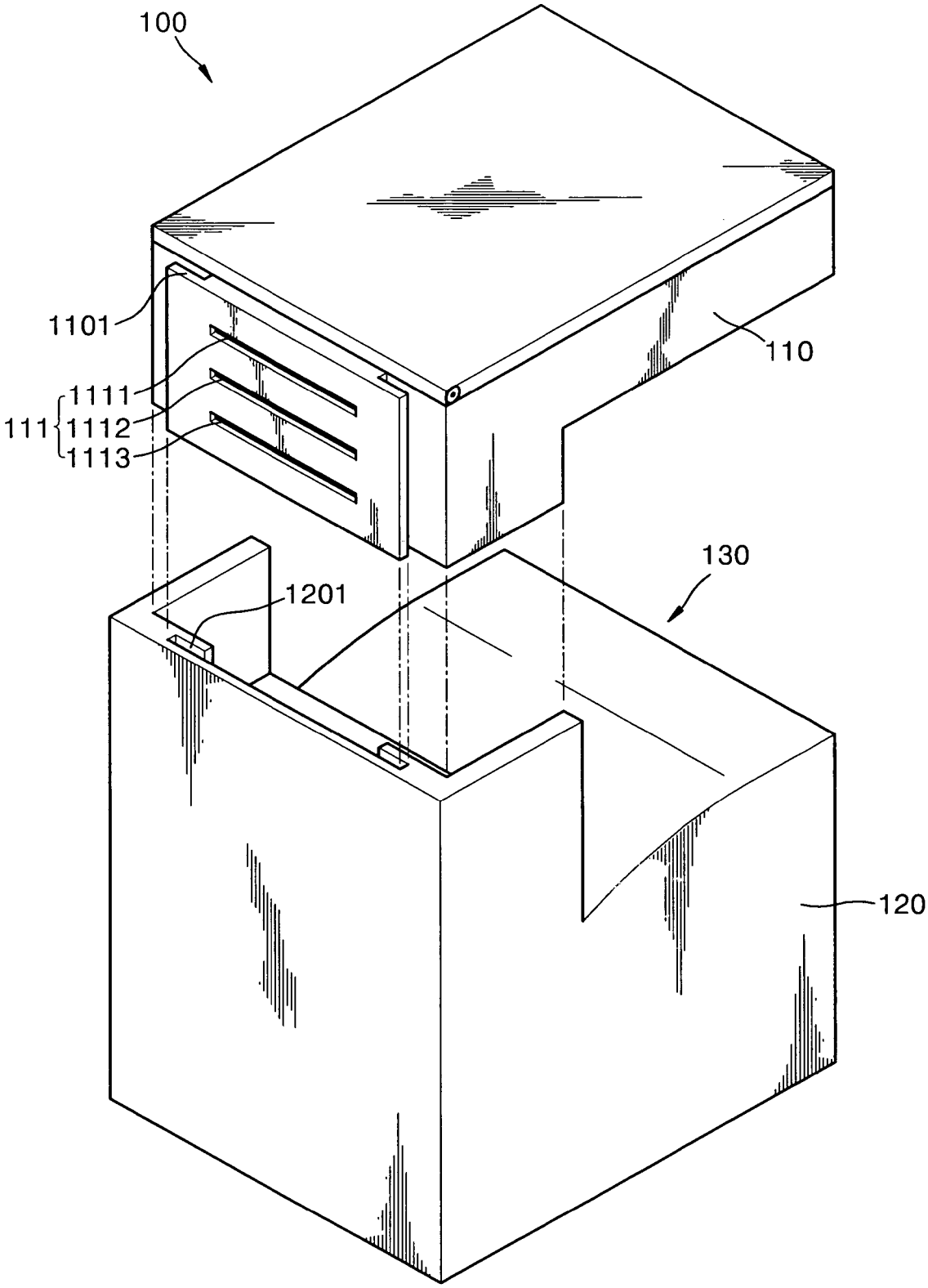
FIG. 2 is a front perspective view of top and bottom frames of an image forming apparatus according to an embodiment of the present invention.
Figure 3:
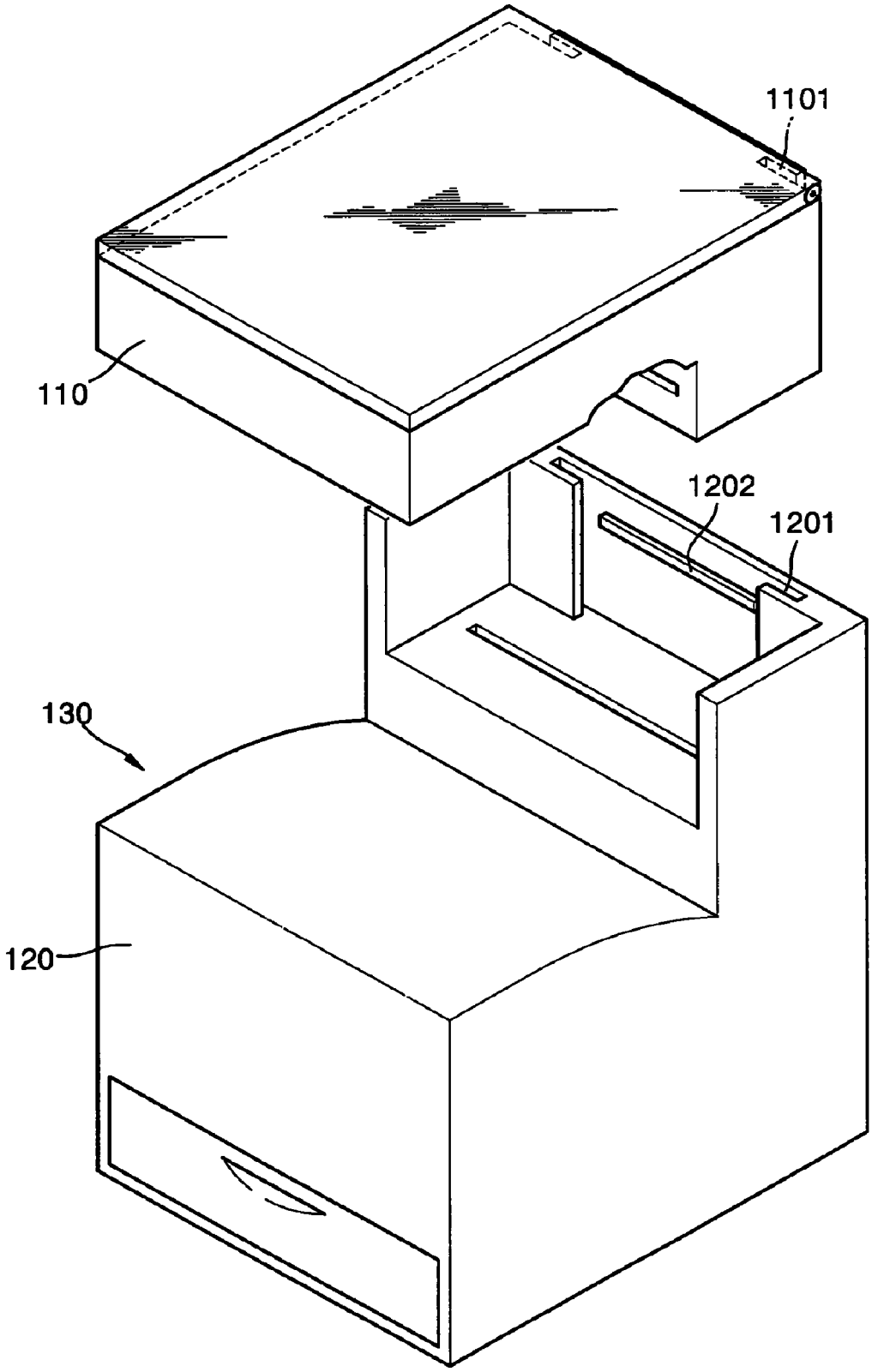
FIG. 3 is a back perspective view of the top and bottom frames of the image forming apparatus according to an embodiment of the present invention.
Figure 4:
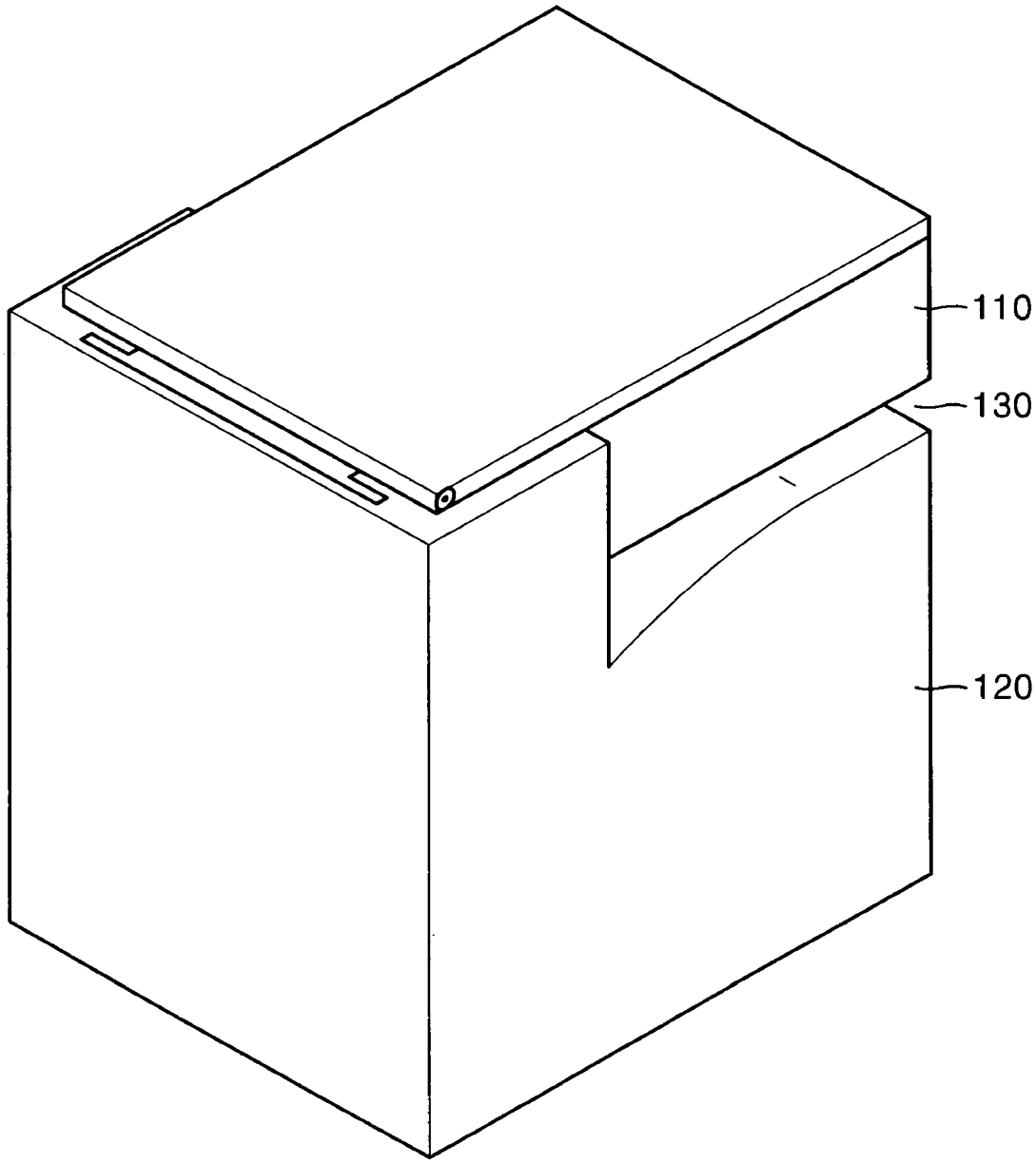
FIG. 4 is a perspective view illustrating the image forming apparatus configured for moving or storage according to an embodiment of the present invention.
Figure 5:
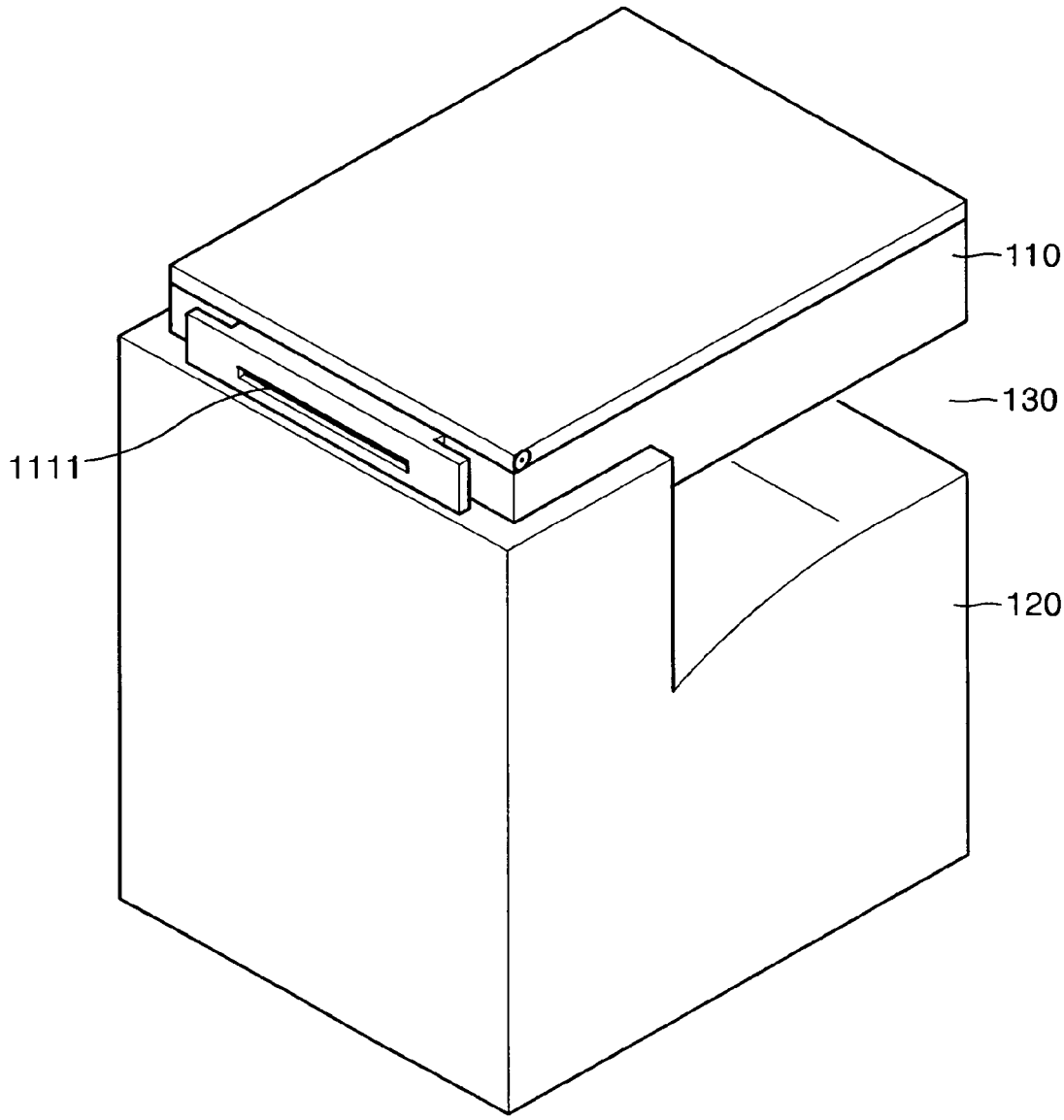
FIG. 5 is a perspective view illustrating the image forming apparatus when a sufficient amount of printing paper is stacked on a paper stack in the image forming apparatus according to an embodiment of the present invention.
Figure 6:
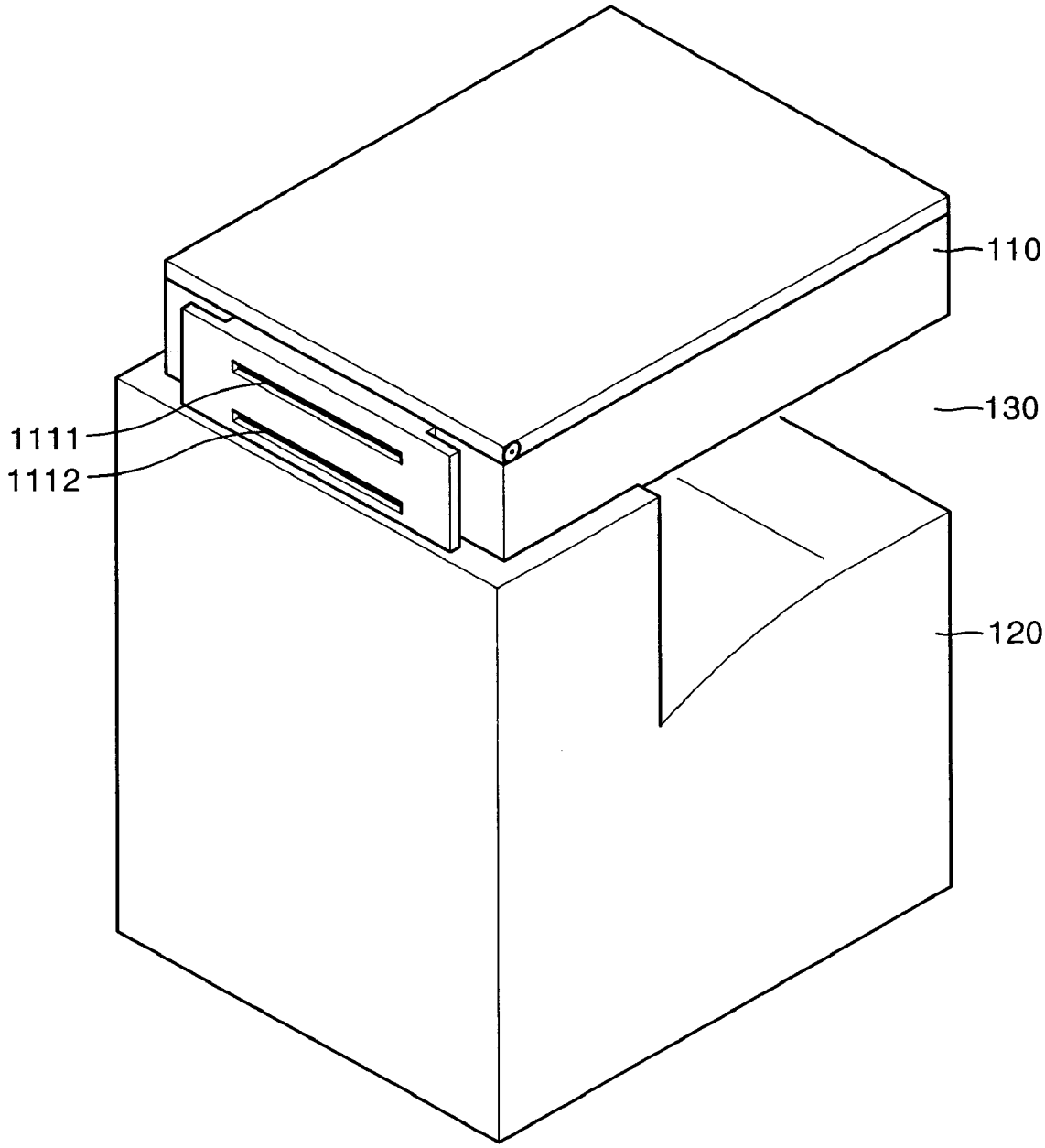
FIG. 6 is a perspective view illustrating the image formatting apparatus when the image forming apparatus is fully loaded with printing paper according to an embodiment of the present invention.
Figure 7:
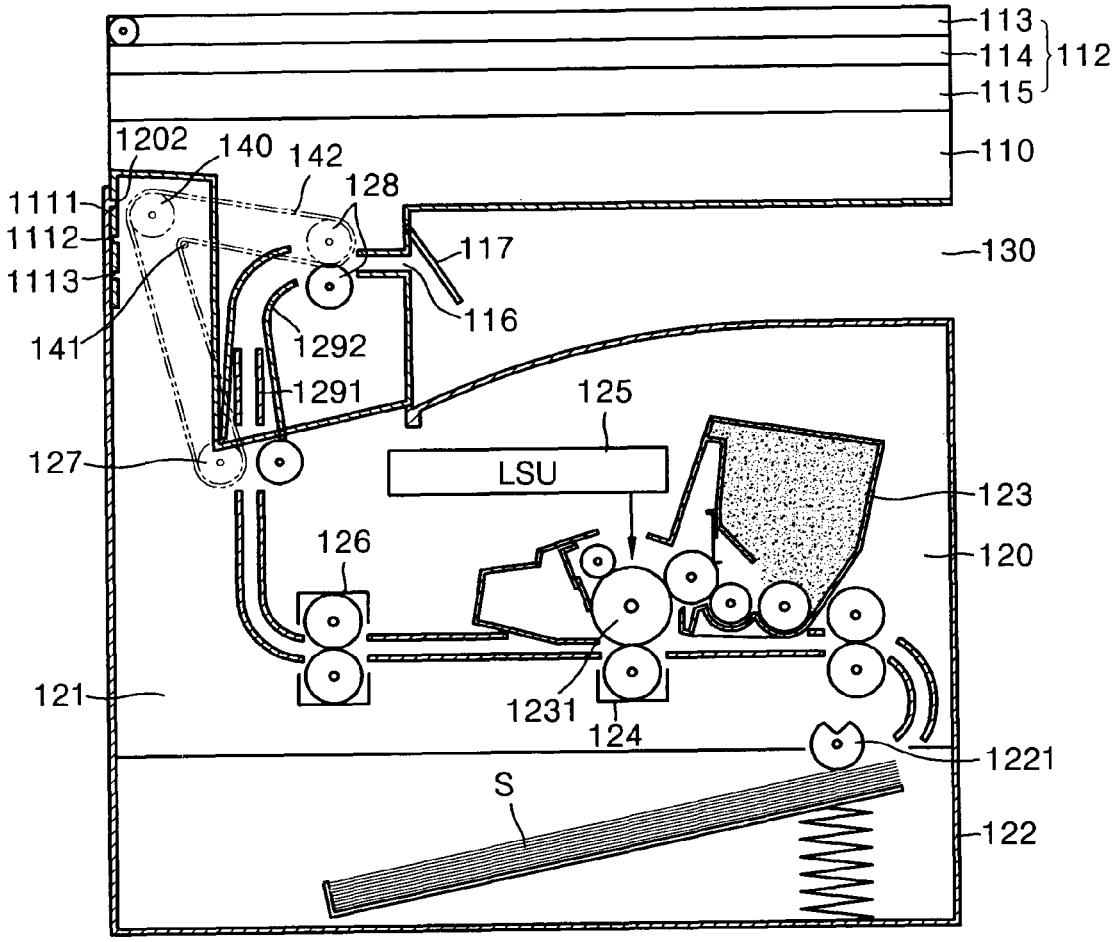
FIG. 7 is a cross-sectional view of the image forming apparatus illustrated in FIG. 4.
Figure 8:
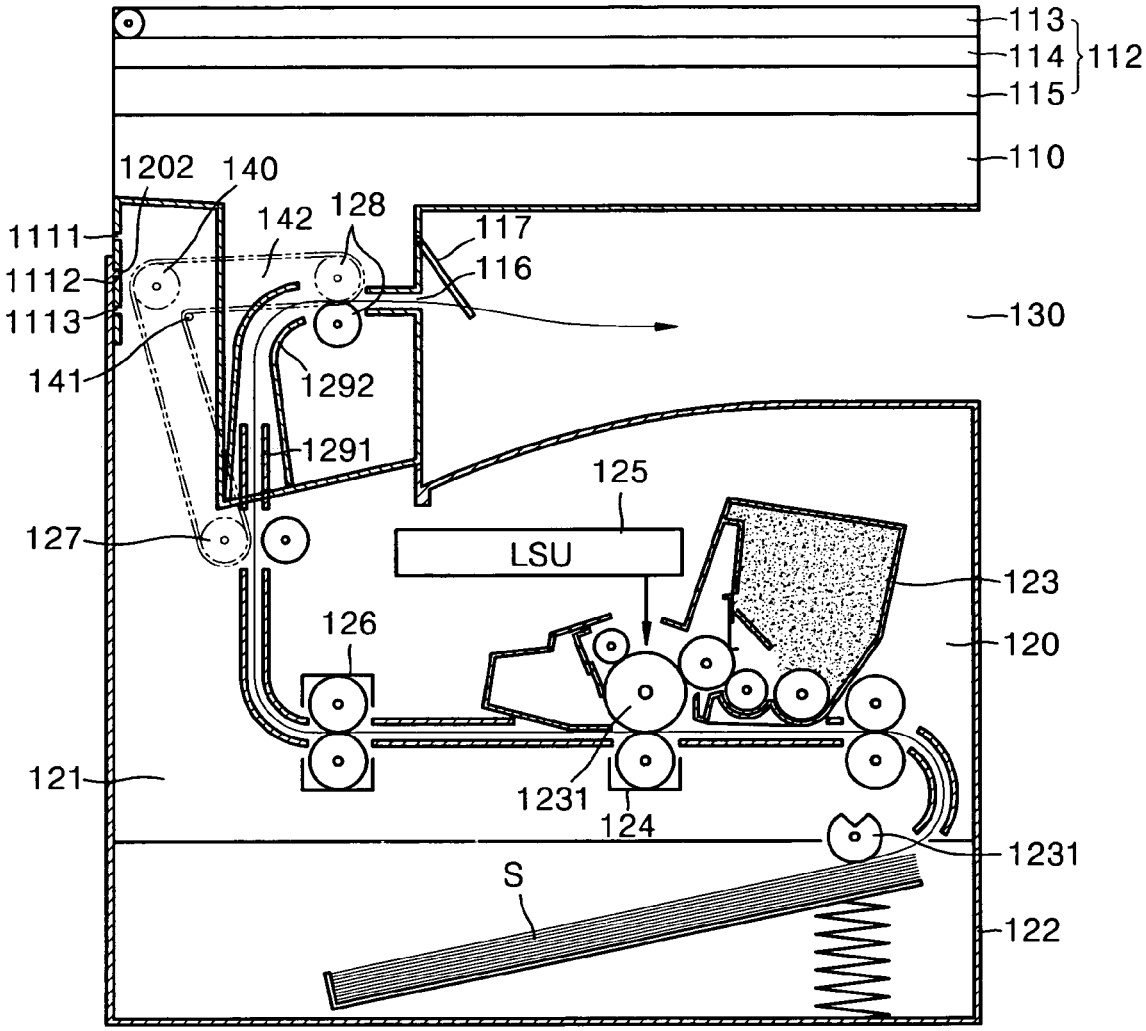
FIG. 8 is a cross-sectional view illustrating an operational state of the image forming apparatus illustrated in FIG. 5.
Figure 9:
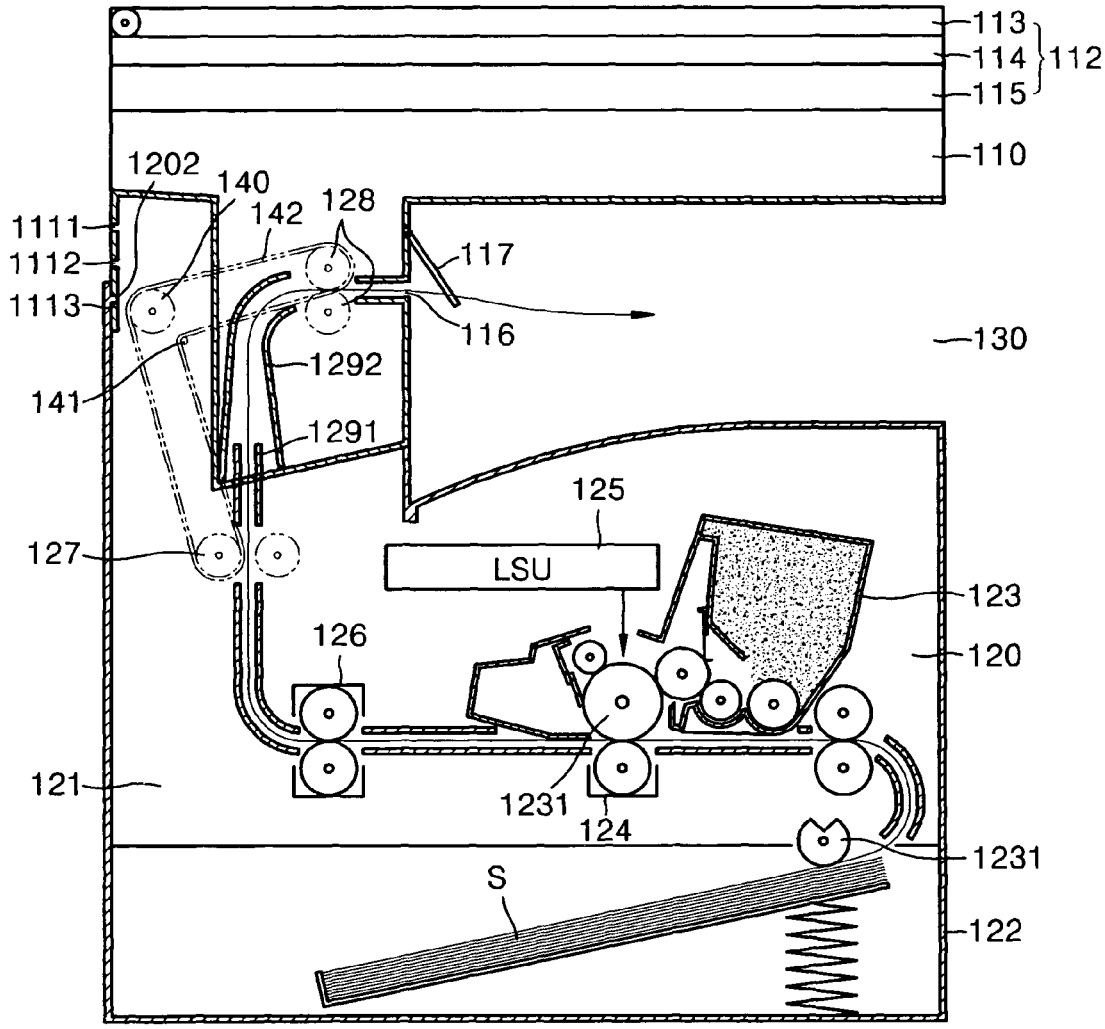
FIG. 9 is a cross-sectional view illustrating an operational state of the image forming apparatus illustrated in FIG. 6.

FIG. 2 is a front perspective view of top and bottom frames of an image forming apparatus according to an embodiment of the present invention. FIG. 3 is a back perspective view of the top and bottom frames of the image forming apparatus according to an embodiment of the present invention. FIG. 4 is a perspective view illustrating the image forming apparatus configured for moving or storage according to an embodiment of the present invention. FIG. 5 is a perspective view illustrating a case when a sufficient amount of printing paper is stacked on a paper stack in the image forming apparatus according to an embodiment of the present invention, while FIG. 6 is a perspective view illustrating a state when the image forming apparatus is fully-loaded with printing paper according to an embodiment of the present invention. FIG. 7 is a cross-sectional view of the image forming apparatus of FIG. 4, and FIGS. 8 and 9 are cross-sectional views illustrating operating states of the image forming apparatus of FIGS. 5 and 6, respectively.

Referring to FIGS. 2 and 3, an image forming apparatus 100 comprises a bottom frame 120 and a top frame 110 that are able to slide vertically with respect to the bottom frame 120. An image inputting unit 112 (see, for example, FIG. 7), which reads a document and inputs an image, is installed in the top frame 110, and an image forming unit 121 (see FIG. 7) that prints the image is installed in the bottom frame 120. A paper stacker 130 is provided between the top and bottom frames 110 and 120 on which printing paper, having the image formed thereon by the image forming unit 121, is output to and stacked.

A guide unit 1101 is on one side of the top frame 110 and a guide groove 1201 is on the bottom frame 120 to guide a sliding of the guide unit 1101 inserted therein. Therefore, the top frame 110 is vertically-slidable with respect to the bottom frame 120 upon the guide unit 1101 being inserted in the guide groove 1201.

A plurality of grooves 111 are on one side of the guide unit 1101 at predetermined intervals in a vertical direction, and a protrusion 1202 is formed inside the guide groove 1201. The top frame 110 is fixed at a predetermined height with respect to the bottom frame 120 by inserting the protrusion 1202 into one of the plurality of grooves 111. The plurality of grooves 111 are provided at incremental heights, determined in part by provided by dividing the maximum height the top frame 110 can slide vertically with respect to the bottom frame 120. The protrusion 1202 is insertable into and removable from the plurality of grooves 111.

FIG. 4 shows a case when the protrusion 1202 (not shown) is inserted into a first groove 1111 (not shown). This is a case where the top frame 110 is positioned closest to the bottom frame 120, and the height of the paper stack 130 is at the minimum.

This case minimizes the height of the image forming apparatus 100 for packaging and delivering the image forming apparatus 100 or storing the image forming apparatus 100. According to an embodiment of the present invention, the lower surface of the image inputting unit 112 may come in contact with a paper stacking surface of the paper stacker 130.

A structure, having a top frame 110 weakly supported by a bottom frame 120, is strengthened by locating the top frame 110 near to the bottom frame 120 and reducing the height of the paper stack 130. In addition, packaging material and space can also be reduced.

FIG. 6 shows a case when the protrusion 1202 is inserted into a third groove 1113 (not shown). When the top frame 110 is a maximum distance from the bottom frame 120, the height of the paper stack 130 is at the maximum of the total movable height.

FIG. 6 illustrates a case when a maximum amount of printing paper, with an image formed thereon, is to be stacked on the paper stack 130 when carrying out printing operations of the image forming apparatus 100. For substantial printing operations, the height of the paper stack 130 of the image forming apparatus 100 is adjusted to the maximum distance from the bottom frame 120.

FIG. 5 illustrates a case when the protrusion 1202 is inserted into a second groove 1112 (not shown). This is a case when the top frame 110 is a predetermined height from the bottom frame 120. The height of the paper stacker 130 is approximately midway between the heights of FIGS. 4 and 5.

This position is used when piling an appropriate amount of printing papers, with the image formed thereon, on the paper stacker 130 when performing a printing operation of the image forming apparatus 100 when printing individual sheets or printing a small amount of sheets.

As described above, a vertical positioning of the top frame 110 with respect to the bottom frame 120 in the image forming apparatus 100 according to embodiments the present invention has three increments to control the height of the paper stacker 130. However, the present invention is not limited to these embodiments and the height of the paper stacker 130 can be controlled by increasing or decreasing the number of increments depending on the circumstances.

Referring to FIG. 7, the image forming unit 121 includes a paper cassette 122 in the bottom frame 120A developing device 123, a transfer roller 124, a fixing device 126, and a paper output roller 128 are provided at the top frame 110.

The paper cassette 122 stacks paper S, and is removable from the bottom frame 120. A pickup roller 1221 is installed on top of the paper cassette 122 to pick up a sheet of the print paper S individually.

The developing device 123 faces the transfer roller 32, with the print paper S in between. A portion of a photosensitive drum 1231 is exposed. An electrostatic potential image is formed on a surface of the photosensitive drum 1231 that is charged with a predetermined electrostatic potential by an exposing unit 125 such as laser scanning unit (LSU).

The transfer roller 124 is installed directly under, and is in contact with, the photosensitive drum 1231 so as to transfer a toner image formed on the photosensitive drum 1231 onto the print paper S.

The fixing device 126 is installed on the traveling path of the print paper S, and fuses and fixes the toner image onto the print paper S by applying heat and pressure onto the toner image transferred onto the print paper S by the transfer roller 124.

The paper output roller 128 outputs the print -paper S with the toner image fused and fixed thereon by the fixing device 126 to the paper stacker 130.

An out-bin full sensor 117 detects the amount of paper S stacked on the paper stacker 130. The sensor 117 detects the amount of paper S stacked on the paper stacker 130 and indicates an whether an overload may occurs that the user can take actions to adjust the amount of stacked paper S on the paper stacker 130.

That is, the user can adjust the top frame 110 with respect to the bottom frame 120 manually, or the top frame 110 can be adjusted automatically by using an additional motor or other driving sources. Alternatively, the image forming apparatus may indicate to the user whether the user wants to move the top frame 110 up with respect to the bottom frame 120 before starting the printing operation. This may be programmed as a basic setting so that the user can select the operation to control the height of the paper stacker 130. The driving source is not shown in the drawing, but a conventional driving source can be used.

A pair of transporting rollers 127 are provided on the traveling path of the print paper S, which is to transport the print paper S that passed through the fixing device 126 towards the paper output roller 128.

A transporting guide 1291, in a path through which the print paper S is transported, is on the bottom frame 120. An exit guide 1292 is in the top frame 110 and connectable with the transporting guide 1291 by overlapping the exit guide 1292.

Since the exit guide 1292 overlaps the transporting guide 1291, the exit guide 1292 slides on the outside of the transporting guide 1291 when the exit guide 1292 slides vertically together with the top frame 110 with respect to the bottom frame 120.

Therefore, the length of the traveling path of the print paper S also increases or decreases proportionality as the exit guide 1292 slides with respect to the transporting guide 1291. Thus, print paper S passed through the transporting guide 1291 is readily transported to the exit guide 1292.

The paper output roller 128, connected to the transporting roller 127 by a belt 142, receives a rotating force and is driven. A middle portion of the belt 142 is supported by an idle roller 140 and a support member 141. Therefore, the rotating force of the transporting roller 127 is smoothly transferred to the paper output roller 128, because the idle roller 140 and the support member 141 support the belt 142, even when the top frame 110 slides vertically with respect to the bottom frame 120.

That is, the rotating force of the transporting roller 127 is transferred to the paper output roller 128 by the idle roller 140 and the support member 141 supporting the belt 142, to transfer the force between the transporting roller 127 and the paper output roller 128, the distance between each axis which changes, as the top frame 110 slides vertically with respect to the bottom frame 120.

The image inputting unit 112 is installed on the top frame 110 so as to be able to pivot. The image inputting unit 112 comprises a cover 113 covering or exposing a top surface of the top frame 110, and a glass plate 114 positioned below the bottom surface of the cover 113 allowing light through. An image sensor 115 is positioned below the glass plate 114 and emits light onto a document (not shown) placed on the top surface of the glass plate 114 and read the image of the copy.

In the operation of controlling the height of the paper stacker 130 of the multi-functional peripheral device according to an embodiment the present invention, referring to FIGS. 4 and 7, the height of the paper stacker 130 is at the minimum when the protrusion 1202 is inserted into the first groove 111 and fixes the top frame 110 that is slid down to be the closest to the bottom frame 120. The distance around the axes of the transporting roller 127 and the paper output roller 128 is a minimum, and the belt 142, supported by the idle roller 140 and the supporting member 141, is bent to a maximum. The length of the traveling path of the print paper S is at the minimum since the top end of the transporting guide 1291 is inserted into the exit guide 1292.

-As illustrated in FIGS. 6 and 9, the height of the paper stacker 130 is at a maximum when the protrusion 1202 is inserted into the third groove 113, and fixes the top frame 110 that is slid up so as to be the furthermost from the bottom frame 120. The distance of around the axes of the transporting roller 127 and the paper output roller 128 is at a maximum. The belt 142, supported by the idle roller 140 and the supporting member 141, is lengthened in response to the increasing distance between the axes of the idle roller 140 and the supporting member 141. Also, the length of the traveling path of the print paper S is at a maximum since the bottom end of the exit guide 1292 overlaps with the top end of the transporting guide 1291.

As illustrated in FIGS. 5 and 8, the height of the paper stacker 130 is such that print paper S can be stacked during a normal printing operation when the protrusion 1202 is inserted into the second groove 112 and fixes the top frame 110 that is slid up or down a predetermined distance from the bottom frame 120.

In the operation of forming the image on the print paper S in the multi-functional peripheral device with above-mentioned structure, referring to FIGS. 8 and 9, the pickup roller 1221 picks up the upper-most sheet of print paper S stacked in the paper cassette 122, and transfers the sheet of print paper S towards the developing device 123 via the paper traveling path. When the exposure unit 125 emits light onto the surface of the photosensitive drum 1231 in accordance with printing data and forms the electrostatic latent image, the developing device 123 supplies a developer to the electrostatic latent image and converts the electrostatic latent image into the toner image. The toner image is transferred onto the print paper S by the transfer roller 124, and is fused and fixed onto the print paper S when passing the fixing device 126.

The print paper S, on which the toner image is fused and fixed, is stacked in the paper stacker 130 via the transporting roller 127, the paper output roller 128, and a delivery path 116.

As described above, a multi-functional peripheral device according to the present invention has numerous advantages.

First, according to an embodiment of the present invention printing a large job is readily performed by controlling the height of a paper stacker to increase the amount of paper that is stacked in the paper stacker.

Second, increasing the height of the paper stacker and improving the flow of the air improves the cooling effect.

Third, according to an embodiment of the present invention a weak supporting structure of an image forming apparatus is strengthened by reducing the height of the paper stacker and thus reducing damage to a product when transporting.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A multi-functional peripheral device, comprising:

a bottom frame including a paper stacker on which a printed paper is stacked; and a top frame movably installed with respect to the bottom frame, the top frame including an image inputting unit reading a document; and a paper output roller to discharge the printed paper to the paper stacker, wherein one of the bottom frame and top frame has a guide groove and the other of the bottom frame and top frame has a guide unit guided by the guide groove such that the top frame is movable in an upper direction with respect to the bottom frame, and the paper output roller moves with the top frame when the top frame moves with respect to the bottom frame, the guide groove defining a protrusion to receive the guide unit, wherein the top frame comprises:

an exit guide that guides the printed paper towards the paper output roller, and the bottom frame comprises a transporting guide slideably connected to the exit guide to guide the printed paper towards the exit guide, wherein the transporting guide is disposed inside the exit guide.

2. The device of claim 1, wherein the top frame is movable in the upward and in a downward direction with respect to the bottom frame.

3. The device of claim 1, wherein the exit guide overlaps the transporting guide, so that a traveling path of the printed paper also changes as the top frame is adjusted with respect to the bottom frame.

4. A multi-functional peripheral device, comprising:

a bottom frame including a paper stacker on which a printed paper is stacked; and a top frame movably installed with respect to the bottom frame, the top frame including an image inputting unit reading a document; and a paper output roller to discharge the printed paper to the paper stacker, wherein one of the bottom frame and top frame has a guide groove and the other of the bottom frame and top frame has a guide unit guided by the guide groove such that the top frame is movable in an upper direction with respect to the bottom frame, and the paper output roller moves with the top frame when the top frame moves with respect to the bottom frame, wherein the top frame comprises:

an exit guide that guides the printed paper towards the paper output roller, and the bottom frame comprises a transporting guide slideably connected to the exit guide and guiding the printed paper towards the exit guide, wherein the paper output roller is driven by being connected to a transporting roller installed in the bottom frame.

5. The device of claim 4, wherein the paper output roller is driven by being connected to the transporting roller via a belt.

6. The device of claim 5, wherein the belt is supported by an idle roller and a supporting member installed in the bottom frame.

7. A multi-functional peripheral device, comprising:

a bottom frame including a paper stacker on which a printed paper is stacked; and a top frame movably installed with respect to the bottom frame, the top frame including an image inputting unit reading a document; and a paper output roller to discharge the printed paper to the paper stacker, wherein one of the bottom frame and top frame has a guide groove and the other of the bottom frame and top frame has a guide unit guided by the guide groove such that the top frame is movable in an upper direction with respect to the bottom frame, and the paper output roller moves with the top frame when the top frame moves with respect to the bottom frame, wherein the bottom frame comprises a protrusion, and the top frame comprises a plurality of grooves, wherein the protrusion is insertable in any of the plurality of grooves, so that the height of the multi-function peripheral device can be controlled in a plurality of steps.

* * * * *